US006751831B2

(12) United States Patent
Willauer et al.

(10) Patent No.: US 6,751,831 B2
(45) Date of Patent: Jun. 22, 2004

(54) METHOD OF FORMING A THREE-DIMENSIONAL CAMOUFLAGE FABRIC

(75) Inventors: Howard C. Willauer, Spartanburg, SC (US); J. David Strength, Spartanburg, SC (US); William L. McLeod, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 207 days.

(21) Appl. No.: 09/767,651

(22) Filed: Jan. 23, 2001

(65) Prior Publication Data

US 2002/0098325 A1 Jul. 25, 2002

(51) Int. Cl.[7] ..... A41D 19/00

(52) U.S. Cl. ..... 28/167; 2/900; 28/160; 28/169; 156/61; 156/63; 156/83; 156/84; 156/104; 156/105; 156/183; 264/11; 264/12; 428/36.1; 428/59; 428/60; 428/88; 428/98; 428/103; 428/104; 428/121; 428/122; 428/130; 428/139; 428/141; 428/152; 428/907; 442/123; 442/164; 442/181; 442/304; 442/327

(58) Field of Search ..... 2/900; 28/160, 28/167, 169; 156/61, 63, 83, 84, 104, 105, 183; 264/11, 12; 428/36.1, 59, 60, 88, 98, 103, 104, 121, 122, 130, 139, 141, 152, 155, 195, 907, 359, 360, 365; 442/123, 152, 164, 304, 329, 181

(56) References Cited

U.S. PATENT DOCUMENTS

| | | | | | |
|---|---|---|---|---|---|
| 4,418,451 | A | | 12/1983 | Crenshaw | 26/2 R |
| 4,670,317 | A | | 6/1987 | Greenway | 428/89 |
| 5,035,031 | A | * | 7/1991 | Elliott | 26/69 R |
| 5,261,978 | A | | 11/1993 | Reynolds | 156/84 |
| 5,445,863 | A | | 8/1995 | Slagle et al. | 428/17 |
| 5,476,561 | A | | 12/1995 | Bylund et al. | 156/85 |
| 5,486,385 | A | * | 1/1996 | Bylund et al. | 428/17 |
| 5,695,835 | A | | 12/1997 | Weber et al. | 428/17 |

FOREIGN PATENT DOCUMENTS

| | | | |
|---|---|---|---|
| EP | 0 121 290 A1 | 1/1984 | D06C/23/00 |

* cited by examiner

*Primary Examiner*—Arti R. Singh
(74) *Attorney, Agent, or Firm*—Terry T. Moyer; Jeffery E. Bacon

(57) ABSTRACT

A base textile with a camouflage pattern is subjected to hot fluid streams to create flat regions and puckered or wrinkled regions, enhancing the three dimensional characteristics of the resulting material.

16 Claims, 1 Drawing Sheet

METHOD OF FORMING A THREE-DIMENSIONAL CAMOUFLAGE FABRIC

BACKGROUND

The primary purpose of camouflage is to hide a person or an object. This is often accomplished using a fabric printed with a camouflage pattern. The pattern may resemble tree limbs, leaves, rocks, and attempts to appear three dimensional. The colors selected for use in the printed pattern help blend the object into the environment, while the pattern provides an artificial depth and contrast to break up the outline of the person or object.

Three dimensional camouflage can provide greater artificial depth and contrast, increasing the ability of the material to hide the person or object. Three dimensional camouflage is typically formed from netting material or multiple pieces of fabric joined together in a single unit. These methods of forming three dimensional camouflage are costly. Therefore, there is a need for camouflage material having a three dimensional appearance.

DETAILED DESCRIPTION

Figure 1:
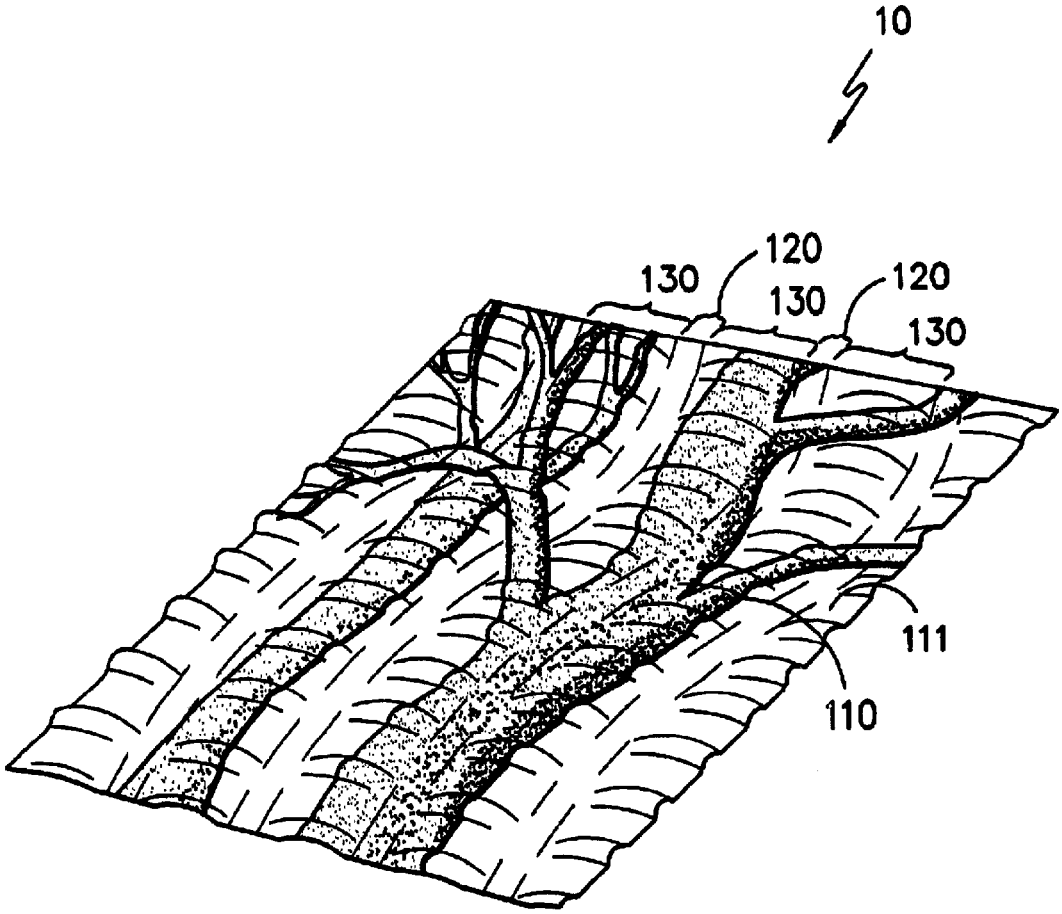
FIG. 1 is a camouflage material incorporating the present invention.

Referring now to FIG. 1, there is shown a material 10, incorporating the present invention. The material 10 is a base textile 100 having a camouflage pattern 110 on an outer surface 111 of the base textile 100, such as a pattern resembling tree trunks, branches, limbs, twigs, leaves, rocks, grass, weeds, or other natural designs. The camouflage pattern 110 can also be regions or zones of differing colors and/or shades that have a tendency to blend with the surrounding environment. The material 10 includes flat regions 120 and puckered or wrinkled regions 130 in the base textile 100. As used herein the terms "flat" areas shall mean areas being relatively later than the "puckered or wrinkled" areas, and can include areas that are not necessarily flat but are flatter than the puckered or wrinkled areas. The puckered or wrinkled regions 130 help to create the three dimensional appearance of the material 10.

In the embodiment illustrated, the base textile 100 is a textile formed of a thermoplastic material, or blends of thermoplastic materials and non-thermoplastic materials such as man-made or natural materials. The base textile 100 can be woven (such as plain or satin weave), knitted, non-woven, or the like. It has been found that base textiles with a more open or loose construction provide a better contrast between the flat regions 120 and the puckered or wrinkled regions 130 of the final material 10. In one embodiment, the yarns forming the base textile 100 are a polyester material. In another embodiment, the yarns forming the base textile 100 are nylon. The base textile 100 can be formed of monofilament, multifilament, and/or staple yarns. Additionally, the yams forming the base textile 100 can be textured yarns. It has also been found that textiles with lower weights per square area perform better as the base textile than heavier textiles. In one embodiment, the base textile 100 is a plain weave textile formed of 70 denier per yarn textured polyester yam, with about 90 yarns per inch in the warp direction and about 85 yarns per inch in the fill direction, and a weight of about 2.2 oz/yd$^2$.

The camouflage pattern 110 can be placed on the base textile 100 by printing, silk screening, transfer printing, lithographing, jet printing, or any other suitable method of applying a design to a textile. Additionally, it is contemplated that the design can be a part of the yarns or material that make up the base textile 100.

As illustrated in FIG. 1, the flat regions 120 are columns extending generally in the vertical direction of the pattern 110, and the puckered or wrinkled regions 130 alternate between the flat regions 120. However, it is anticipated that the flat regions 120 and the puckered or wrinkled regions 130 can be arranged in any configuration that enhances the three dimensional appearance of the material 10. For example, the flat regions 120 can be disposed in the area of the camouflage pattern 110 that represents the space between the objects in the pattern 110, such as leaves, twigs, rocks, or the like, and the puckered or wrinkled region 130 can be disposed in the area of the camouflage pattern 120 that represents the objects in that pattern. Similarly, the flat regions 120 can be disposed in the area of the camouflage pattern 110 that represents the objects in the pattern 110, such as tree trunks, branches, limbs, twigs, leaves, rocks, weeds, grass, or the like, and the puckered or wrinkled region 130 can be disposed in the area of the camouflage pattern 120 that represents the space between the objects in that pattern.

In one embodiment of the present invention, the base textile 100 is made by forming a base fabric, placing the camouflage pattern onto the base fabric, forming the flat regions and puckered or wrinkled regions on the base fabric.

The base textile can be formed by weaving, knitting, non-woven methods. The camouflage pattern can be place onto the base fabric by printing, silk screening, air brushing, transfer printing, lithograph, jet printing, printing, or any other suitable method of applying a design to a textile. Alternatively, the base textile can be formed with materials that create the camouflage on the base textile 100.

In one embodiment, the flat regions 120 and the puckered or wrinkled regions 130 can be formed in the base fabric by subjecting the areas to be the flat regions 120 to streams of hot fluid such as from hot air jets. The hot fluid streams shrink the yarns of the base textile 110, thereby causing the areas of the base textile 110 not subjected to the hot fluid streams to wrinkle or pucker. In one method, the hot fluid streams are aligned in rows, and the base textile 110 is moved below the rows of hot fluid streams. When the base textile 110 is moved in the warp direction, an entire roll of base textile 110 can be treated to create the flat regions 120 and the puckered or wrinkled regions 120.

In one embodiment, the base textile 100 is coated with finishing lubricants prior to subjecting the base textile 100 to the hot fluid streams. It has been found that using the lubricants facilitates the shrinkage of the flat regions 120 of the base textile 100 that are subjected to the hot fluid streams, thereby emphasizing the puckered or wrinkled regions 130 of the material 10. Additionally, it has been found that washing the material 10 after subjecting the base textile 100 to the hot fluid streams, assists in shrinking the flat areas 120 of the material 10 thereby emphasizing the puckered or wrinkled areas 130 of the material 10.

In has been found that subjecting the base textile 100 with the camouflage pattern 110 thereon to the above processes, creates a greater pick density (yarns per linear distance) in the areas that come into contact with the hot fluid streams over the areas that do not come into contact with the hot fluid streams. The greater pick density occurs in the warp and/or the fill yarns of the material, depending on the type of material used in the warp and fill yarns. The areas with the greater pick density coincide with the flat areas 120 of the of material 10, and the areas with the lower pick density coincide with the wrinkled or puckered areas 130 of the material 10. Therefore, for a material 10 having a particular predetermined number of picks in the warp and the fill, the density of the warp and/or fill of the material 10 will be greater in the flat areas 120 than the wrinkled areas 130. It is believed that the contrast in densities of the two areas are what causes the puckered or wrinkled areas 130 of the material 10.

What is claimed is:

1. A method of forming a three dimensional camouflage textile, comprising the steps of:

forming a base textile with yarns having a thermoplastic material therein;

applying a camouflage pattern to the base textile;

forming flat regions and wrinkled regions in the base textile, the flat region being formed by the application of a hot fluid stream to the yarns having a thermoplastic material and the wrinkled regions being formed by the shrinking of the yarns having a thermoplastic material due to the application of the hot fluid stream.

2. The method according to claim 1, wherein said step of forming the base textile comprises weaving the base textile.

3. The method according to claim 2, wherein the step of weaving the base textile includes weaving the base textile in a plain weave pattern.

4. The method according to claim 2, wherein the step of weaving the base textile includes weaving the base textile in a satin weave pattern.

5. The method according to claim 1, wherein said step of forming the base textile comprises knitting the base textile.

6. The method according to claim 1, wherein said step of forming the base textile comprises forming the base textile as a nonwoven material.

7. The method according to claim 1, wherein said step of forming the flat and wrinkled regions includes orienting hot fluid streams in a row adjacent to the base textile, and creating a relative movement between the base textile and the row of hot fluid streams.

8. The method according to claim 1, further including the said disposing a finishing lubricant on the base textile prior to forming the flat and wrinkled regions.

9. A method of forming a three dimensional camouflage textile, comprising the steps of:

forming a base textile with yarns having a thermoplastic material and a camouflage pattern therein; and forming flat regions and wrinkled regions in the base textile, the flat region being formed by the application of a hot fluid stream to the yarns having a thermoplastic material and the wrinkled regions being formed by the shrinking of the yarns having a thermoplastic material due to the application of the hot fluid stream.

10. The method according to claim 9, wherein said step of forming the base textile comprises weaving the base textile.

11. The method according to claim 10, wherein the step of weaving the base textile includes weaving the base textile in a plain weave pattern.

12. The method according to claim 10, wherein the step of weaving the base textile includes weaving the base textile in a satin weave pattern.

13. The method according to claim 9, wherein said step of forming the base textile comprises knitting the base textile.

14. The method according to claim 9, wherein said step of forming the base textile comprises forming the base textile as a nonwoven material.

15. The method according to claim 9, wherein said step of forming the flat and wrinkled regions includes orienting hot fluid streams in a row adjacent to the base textile, and creating a relative movement between the base textile and the row of hot fluid streams.

16. The method according to claim 9, further including the said disposing a finishing lubricant on the base textile prior to forming the flat and wrinkled regions.

* * * * *